US008272306B1

(12) United States Patent
Smith

(10) Patent No.: US 8,272,306 B1
(45) Date of Patent: Sep. 25, 2012

(54) ADJUSTABLE SILENCER BOOSTER WITH SPOKED PISTON ENGAGEMENT SHOULDER

(75) Inventor: Mike Smith, Alpharetta, GA (US)

(73) Assignee: Advanced Armament Corp., Norcross, GA (US)

( * ) Notice: Subject to any disclaimer, the term of this patent is extended or adjusted under 35 U.S.C. 154(b) by 0 days.

(21) Appl. No.: 12/221,715

(22) Filed: Aug. 6, 2008

(51) Int. Cl.
*F41A 21/30* (2006.01)

(52) U.S. Cl. ..... 89/14.4; 181/223

(58) Field of Classification Search ..... 89/14.05–14.5; 181/223
See application file for complete search history.

(56) References Cited

U.S. PATENT DOCUMENTS

| | | | | |
|---|---|---|---|---|
| 3,677,132 | A * | 7/1972 | Plenge | 89/14.2 |
| 5,029,512 | A * | 7/1991 | Latka | 89/14.4 |
| 7,059,235 | B2 * | 6/2006 | Hanslick et al. | 89/14.3 |
| 7,588,122 | B2 * | 9/2009 | Brittingham | 181/223 |
| 2007/0095198 | A1 * | 5/2007 | Dater et al. | 89/14.2 |

OTHER PUBLICATIONS

AAC Evolution-9. 9MM Shootout and Pistol Trials. Oct. 12, 2007 <http://www.silencerresearch.com/9mm_shootout_and_pistol_trials.htm> and <http://web.archive.org/web/*/http://www.silencerresearch.com/9mm_shootout_and_pistol_trials.htm> and <http://web.archive.org/web/20071012150848/http://silencerresearch.com/9mm_shootout_and_pistol_trials.htm>.*

AAC Glock 9mm Suppressors, For Glock 17, 19, and 26 with AAC Evolution-9, Spider-2, Scorpion!; by Al Paulson; Combat Handguns; Harris Publications; Jun. 2006 issue.

AAC's Evolution-9, Suppressing hard-to-silence 9mm pistols including Beretta 92F; by Al Paulson; Special Weapons for Military and Police; Harris Publications; Fall 2002 issue.

*Multimount System*. (2008) Retrieved from http://www.gem-tech.com/MultiMount.html.

* cited by examiner

*Primary Examiner* — Gabriel Klein
(74) *Attorney, Agent, or Firm* — Womble Carlyle Sandridge & Rice LLP

(57) ABSTRACT

The herein proposed device relieves an autoloading handguns' barrel from the weight of the silencer allowing it to cycle properly. This improved booster housing for a silencer affords the user ten positions of orientation. A more robust orientation mechanism which minimizes rotational movement of the associated piston when it is fully seated within the booster housing is provided for. Increased accuracy of the host firearm is achieved through the minimization of rotational play. My improved booster housing design is lighter in weight than other similar designs and utilizes a coaxial expansion chamber between the housing and the interior of the silencer tube to increase sound reduction.

6 Claims, 4 Drawing Sheets

ADJUSTABLE SILENCER BOOSTER WITH SPOKED PISTON ENGAGEMENT SHOULDER

BACKGROUND OF THE INVENTION

1. Field of Invention

This invention relates in general to silencers and in particular to devices which are utilized with silencers, to alleviate the weight of a silencer, to allow the proper semi automatic function of a handgun which utilizes a Browning inspired operating system.

2. Prior Art

Silencers for handguns are well known in the prior art and have been used by the US military forces since World War II. Reducing the recoil, muzzle flash, and sound signature of the host firearm through the use of a silencer offers many advantages to the user. Muzzle flash is harmful to the user's night vision and provides a visual cue as to the location of the person discharging a firearm. The sound provides a visual cue to the location of a shooter and is harmful to his or her hearing. Silencers mitigate or eliminate these concerns. The device herein described is a booster which is utilized with a silencer to assist in the proper semi auto function of an autoloading handgun. Further, a system for orienting the silencer in relationship to the muzzle has been provided for.

Autoloading handguns are well known in the prior art. Expanding gases from a discharged projectile are utilized as a means to cycle the handgun thereby extracting a spent cartridge from the barrel's chamber, ejecting it and then loading a fresh cartridge, from a magazine, into the barrel's chamber. Designs which are based on or copies of those created by John Browning, utilize a breech lock system where the barrel tilts. The proximal end of the barrel goes down below the axis of the slide while the distal end of the barrel goes up above the axis of the slide. Firearms which utilize a variant of this locking mechanism include Colt, Glock, Heckler & Koch, Kimber, and SIG all of whom are well known manufacturers in the firearms industry. Advantages of an auto loading handgun, which provides for fast follow up shots and a higher magazine capacity as compared to revolvers, are well known.

The ability of a barrel's muzzle to rise above the axis of the slide is critical to proper function. The systems are designed to function without any additional weight on the muzzle of the barrel. As such, the inclusion of a silencer is often problematic. Designers needed a way to relieve the barrel of the weight of an attached silencer thereby allowing the handgun to function normally. Boosters, as they are commonly known, were developed to allow for the proper function of a handgun and silencer which utilized one. Designs such as the Advanced Armament Corp. ASAP and the Gemini Technology Neilson Device are two examples of boosters.

Boosters such as the one presented here enable reliable functioning of self-loading firearms that employ the Browning tilt-barrel locking system. If a silencer without a booster system is attached to virtually any self-loading firearm that employs the Browning tilt-barrel locking system, the weight of the silencer will bear down on the front of the barrel and disable the rear of the barrel from tilting downward as designed to affect the unlocking of the slide from the barrel to allow the extraction and ejection of the empty cartridge case and the feeding of a live cartridge into the chamber.

To understand how the Advanced Armament Corp. ASAP system works, a brief explanation of the design is necessary. The ASAP system isolates the mass of the silencer from the self-loading firearm. The interface piston is attached to the barrel of the self loading firearm by a mechanical attachment.

The piston has a shaft with the mechanical attachment at one end, and a flange at the other end. There is a bore through the interface piston that allows free passage of the fired projectile. The silencer has a piston interface housing at the rear, with a stop for the piston in the forward end of the housing. The stop has a bore through which a fired projectile may pass unhampered, but is small enough that the piston head may not pass through. The piston interface is placed inside the piston interface housing so that the head of the piston rests against the piston interface stop at the forward end of the housing. A driving spring is placed inside the piston interface housing and around the piston shaft. The rear cap is attached to the piston interface housing via threads or another means of mechanical attachment, and has a bore through which the piston shaft may slide freely, but not the piston head. By installing the rear cap, the spring is held captive by the head of the piston and the inner face of the rear cap. When a silencer with an ASAP system is fired, the projectile travels down the barrel, through the bore in the attached piston, through the bore in the piston stop, and into the silencer. The gases propelling the projectile follow the same path as the projectile, but expand inside the silencer. These expanding gases push the silencer, piston interface housing, and rear cap forward against the tension of the spring. The spring and the piston are the only unsprung mass that is not propelled forward. As the weight of the silencer decouples from the barrel, the barrel is able to tilt downward at the rear, allowing the extraction and ejection of the empty cartridge case and the feeding of a live cartridge into the chamber. The driving spring then resets the silencer, piston interface housing, and rear cap back to their pre-fired position in anticipation of the following discharge.

While there are several designs on the market which function as a reliable booster for Browning inspired designs these designs have other deficiencies. Designs such as the Advanced Armament Corp. ASAP system (previous design) and the Gem-Tech Linear Inertial Decoupler recoil enhancer utilized a single set screw which prevents rotational movement of the silencer about the piston. These screws can back out during recoil. If improper solvents are used to clean the silencer, the adhesive which holds the screw into the housing can be dissolved allowing the screw to become threadedly unsecured. The screw is also known to break at times due to manufacturing defects. Further, the screw utilized only prevents gross rotational movement. If the silencer is allowed to freely rotate about the piston, the accuracy potential of the hand gun in use is severely diminished.

Another issue is related to the maintenance of the booster assembly. Traditional designs have relied on specialized tools to disassemble the booster. This requires that the user keep up with a tool which is not attached to the silencer itself. Further, such tools are generally so specific that there would be no substitute readily available from a source other than the manufacturer.

Still another issue is manufacturing efficiency. Having to secure a screw into the side of the housing by hand is inefficient and slow. Machining the indexing notches into the housing is more time efficient and provides a more robust indexing interface.

My device improves upon these previous designs is several ways. First, ten individual slots are evenly spaced about the interior of the booster housing. The slots are machined so that they receive the ten spokes present on the distal end of the piston.

Rotational movement is eliminated, not reduced. Further the utilization of ten individual indexing slots which are machined into the housing provides a more robust retention system for the piston. No one slot is bearing all of the rotation force being applied by the silencer.

Unrestrained rotational movement is no longer a concern for the user of my improved booster.

My novel device incorporates a provision which allows the user to disassemble the booster for maintenance without the need of special tools.

Additional objects, advantages, and novel features of the invention will be set forth in part in the description as follows, and in part will become apparent to those skilled in the art upon examination of the following, or may be learned by practice of the invention.

3. Objects and Advantages

Accordingly several objects and advantages of the present invention are (a) To provide a device which temporarily relieves the firearm barrel of the weight associated with an attached silencer to facilitate proper cycling of the host firearm.

(b) To provide an improved method for adjusting the silencer's orientation as it relates to the host firearm's barrel.

(c) To provide a more robust mechanism for the retention of the piston within the booster housing.

(d) To provide a device which minimizes rotational play once the piston is seated within the housing.

(e) To provide a device that is lighter in weight than similar designs.

Still further objects and advantages will become apparent from a consideration of the ensuing description and drawings.

SUMMARY

The herein described invention was designed to improve the functionality of boosters for handgun silencers. The lightweight booster housing, in one embodiment, is threaded into the housing of a silencer. The booster includes a piston, compression spring, housing and rear cap. A piston provides a method for attaching the booster, and thereby the silencer, to a firearm barrel. Textured features have been machined about the exterior of the rear cap to facilitate removably securing the piece onto the booster housing. Also provided are ten individual indexing slots, each of which interfaces with a single spoke present on the distal end of the piston, thereby eliminating rotational movement of the piston when it is fully seated within the housing. A compression spring prevents the piston from translocation in either a forward or rearward direction without an effort on the part of the user or the discharging of a firearm. The indexing method provided is robust and provides ten positions of orientation. Accuracy of the host firearm will not be diminished by the use of the disclosed booster.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
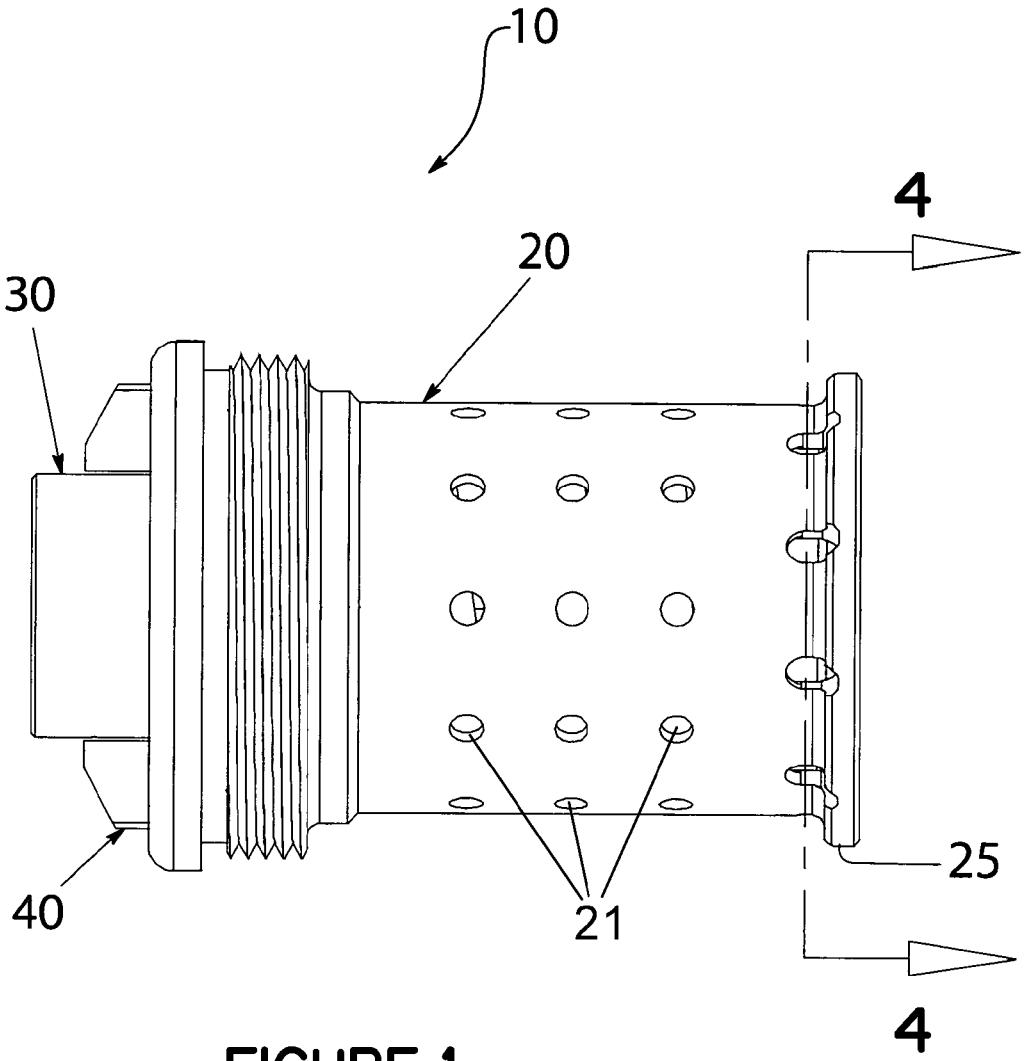
FIG. 1 is a side view of my light weight booster which allows for adjustable orientation of an attached silencer.

Turning now to the drawings in which like reference characters indicate corresponding elements throughout the several views, attention is directed to FIG. 1 which illustrates an embodiment of a light weight booster 10 which allows for adjustable orientation of an attached silencer. This embodiment of the herein disclosed invention is comprised of a housing 20, a piston 30, rear cap 40, and compression spring 50 (shown in FIG. 2).

Figure 2:
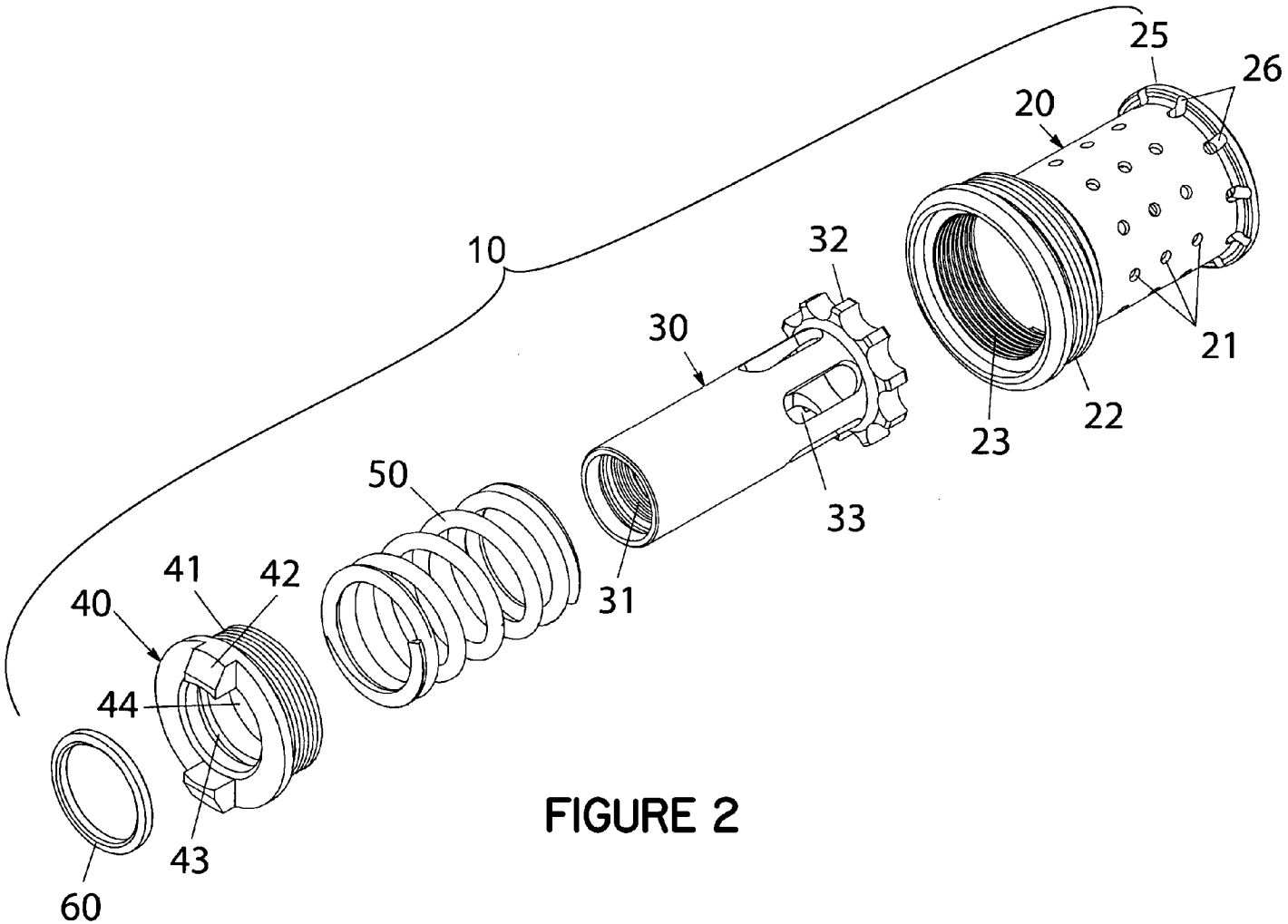
FIG. 2 is an exploded perspective view thereof.
Figure 3:
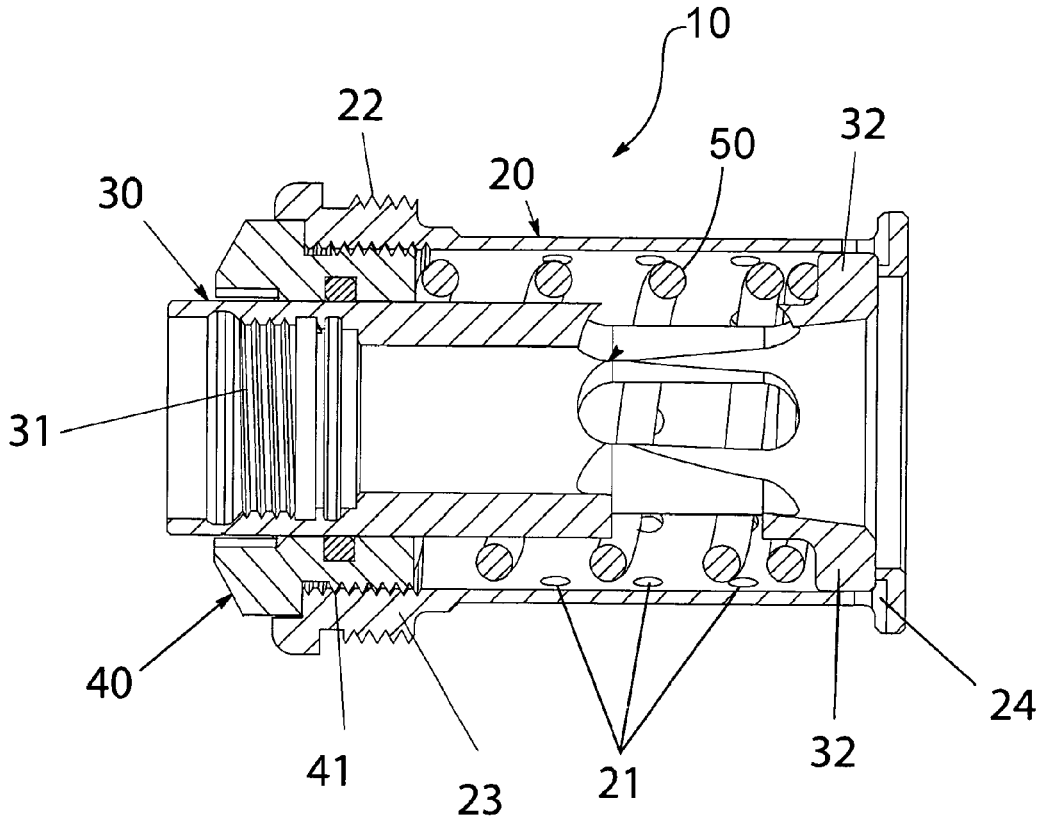
FIG. 3 is a longitudinal sectional view thereof.

As used herein, the word "front" or "distal" corresponds to the direction which a discharged projectile would pass through the light weight booster 10 (i.e., to the right as shown in FIGS. 1 thru 3); "rear" or "proximal" or "back" corresponds to the direction opposite the direction of a discharged projectile passing through the light weight booster 10 (i.e., to the left as shown in FIGS. 1 thru 3); "longitudinal" means the direction along or parallel to the longitudinal axis of the light weight booster 10; and "transverse" means a direction perpendicular to the longitudinal direction.

FIG. 2 shows an exploded view of the components which comprise the preferred embodiment of my invention. The housing 20 is a cylinder with several features of significance. There are a series of vents 21 located all around the central portion of the housing 20. At the distal end of the housing 20 there are ten indexing notches 26 and an annular shoulder 25 which is approximately the same diameter as the minor diameter of the housing's 20 external thread 22. The proximal end of the housing 20 has an internal thread 23 which is design to receive the thread 41 on the distal end of the rear cap 40. The piston 30 has ten spokes or flanges 32 which protrude outwardly from the body of the piston 30.

These spokes 32 are spaced evenly about the distal end of the piston 30 and are machined so that they are translatable within the housing 20. Proximate the spokes 32 are five vents 33 which are spaced evenly about the exterior of the piston 30 body. The distal end of the piston has a thread 31 which serves as a mechanical means to attached the piston 30 to a firearm barrel 72 (shown in FIG. 6). A compression spring 50 is provided which has a central void larger enough to accommodate the piston 30. Rear cap 40 has an internal groove 43 which is cut to receive an o-ring 60. Two sloped protrusions 42 which are spaced 180 degrees opposite of each other across the central opening 44 located in the center of the rear cap 40 are present to provide a means by which the rear cap 40 might be threadedly secured. The opening 44 is machined so that the proximal end of the piston 30 will pass through.

FIG. 3 shows a sectional view of the booster 10 fully assembled with the piston 30 located within the housing 20, a compression spring 50 surrounding the piston 30, and a rear cap 40 containing the compression spring 50 and the piston 30 within the housing 20.

Figure 4:
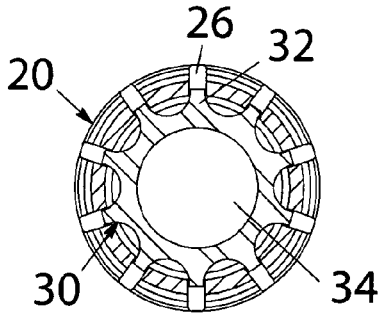
FIG. 4 is sectional view taken along 4-4 of FIG. 1 thereof.
Figure 5:
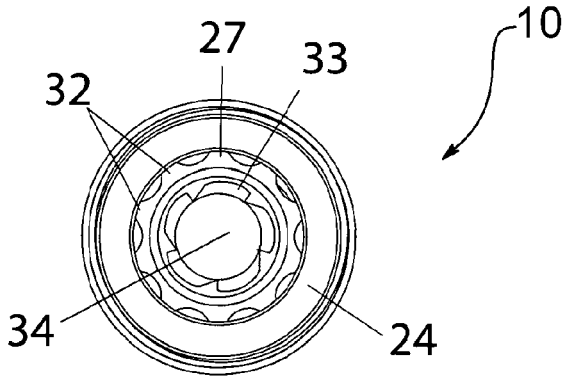
FIG. 5 is an end view thereof.

FIG. 4 illustrates a distal cutaway view of the housing 20 with a piston 30 seated in place. The ten indexing notches 26 spaced about the interior of the housing are machined so that they can receive the ten spokes 32 spaced about the distal end of the piston 30. This prevents the housing 20 from rotating when the piston is fully seated. FIG. 5 details a proximal cutaway view of the housing 20 with a piston 30 seated. Below the indexing notches 26 is an annular shoulder 24 which provides a stopping point for the piston 30. Also shown are the five vents 33 present proximate the distal end of the piston which are cut at an angle and the unobstructed opening 27 present in the housing 20 and the void 34 through the piston 30.

Figure 6:
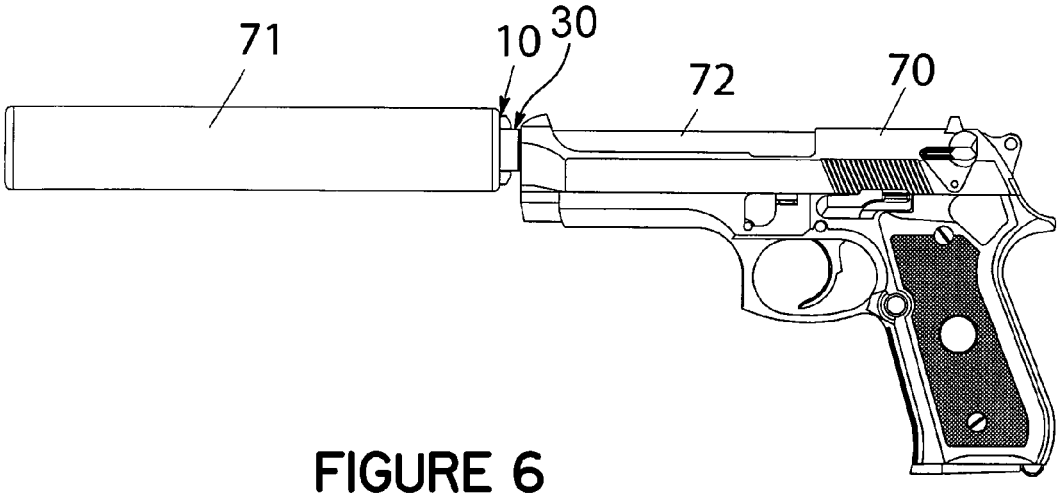
FIG. 6 is a-side view of a handgun utilizing a silencer equipped with the light weight booster which allows for adjustable orientation of the attached silencer.

FIG. 6 shows an external side view of a handgun 70, with a silencer 71, utilizing the lightweight booster 10, secured to the end of the barrel 72. The lightweight booster 10 which allows for adjustable orientation of an attached silencer has a housing 20 which contains all of the major components. The external threads 22 located near the proximal end of the housing 20 are utilized to secure the housing to a silencer body 71. Due to the reduced diameter of the housing 20 and the forward bearing surface 25 located at the distal end of the housing 20 a coaxial space is formed between the silencer body 71 and the housing 20. The perforations 21 located about the housing 20 provide an exit for expanding gases from a discharged firearm 70 to exit into this coaxial space.

The piston 30 has a series of spokes 32 located about its distal end, which is translatable into and out of the piston housing 20. These spokes 32 are of a size which interfaces with the indexing notches 26 located on the interior of the housing 20 proximate the distal end and are of sufficient size to prevent rotational movement. Located proximate the spokes 32 are five vents 33 which provide an escape for the expanding gases of a firearm 70 to exit into the housing 20 and the silencer body 71. These vents 33 increase sound and flash reduction. Located on the interior proximal end of the piston 30 is a thread 31 which provides a mechanical means to removably secure the piston 30, and thereby the light weight booster 10 and silencer body 71 to a firearm barrel 72.

A rear cap 40 is utilized to contain a compression spring 50 which is utilized to keep the piston 30 seated within the housing 20. The rear cap 40 has a thread 41 on its distal end which interfaces with the internal thread 23 located at the proximal end of the housing 20. Located on the rear cap 40 are two protrusions 42 which provide a means whereby the user may removably secure the rear cap 40 to the housing 20. A groove 43 is provided about the interior of the rear cap to contain an o-ring 60. The o-ring 60 provides a seal about the piston 30 to prevent hot gases from escaping the housing's interior.

To utilize the herein described device, a silencer body 71 with the light weight booster 10 must be mechanically attached to a handgun barrel 72. To adjust the orientation of the silencer, the user must pull the silencer body 71 and thereby the light weight booster 10 forward. This action compresses the compression spring 50 and frees the piston spokes 32 from the indexing notches 26 located inside of the housing 20. Ten positions of orientation are possible in the illustrated embodiment, but more or less could be utilized based on the number of spokes 32 and indexing notches 26 present. The user must the rotate, ideally the same direction as would threadedly restrain the piston 30 to the barrel 72, the silencer body 71 to the desired position and release the silencer body 71 thereby causing the piston spokes 32 to interface with the indexing notches 26 again. This allows the user to adjust the silencer body's 71 orientation to the firearm 70 without the need to disassemble the light weight booster assembly 10.

Further, the ten indexing notches 32 prevent not only gross rotational movement but also minor movement as well. By eliminating the movement between the piston spokes 32 and the indexing notches 26 the accuracy of the host firearm 70 is not affected while the ability to affect the point of impact of the host firearm 70 is gained by the adjustable orientation.

The lightweight booster 10 also serves as a booster to ensure the proper semi automatic function of an autoloading handgun 70. When the host firearm 70 is discharged, expanding gases proceed and follow the discharged projectile or bullet out of the barrel 72. An opening 34 is provided through the piston and another opening 27 thru the housing 10 to provide an unobstructed path for the bullet to transverse as it exits the barrel 72. As the expanding gases enter the piston 30 and expand into the housing 10 the pressure generated forces the silencer body 71 forward by compressing the compression spring 50. The piston spokes 32 maintain the orientation of the housing 10 to the barrel 72 by contacting the interior walls of the housing 20. With the silencer housing 71 pushed forward of the handgun barrel 72, the barrel 72 is effectively relieved of the associated weight of the silencer body 71 allowing the handgun 70 to complete its normal cycle of operation.

CONCLUSION, RAMIFICATIONS, AND SCOPE

Accordingly the reader will see that, according to the invention, I have provided an improved booster housing which provides a robust indexing system that eliminates undesirable rotational movement or play within the adjustment mechanism. A coaxial space, between the housing 10 and the silencer body 71, is provided to increase sound reduction. The removal of the material which facilitates the coaxial space also serves to lighten the weight of the housing 10. There herein described light weight booster 10 may be incorporated into any silencer which is designed to be utilized with a handgun or rifle firing a traditional handgun caliber cartridge.

While my above drawings and description contain many specificities, these should not be construed as limitations on the scope of the invention, but rather as an exemplification of one preferred embodiment thereof. For example, my design could utilize more or less spokes 32 than are specified in my preferred embodiment. The co-axial space is not necessary, should the housing need to be strengthened for use with a rifle or larger caliber host weapon. Accordingly, the scope of the invention should be determined not by the embodiments illustrated, but by the appended claims and their legal equivalents.

The invention claimed is:

1. A booster for a silencer, comprising:

a piston with a proximal end and a distal end, the proximal end of the piston configured to couple to a firearm such that a projectile can pass thorough the piston from the proximal end to the distal end, the distal end of the piston comprising a flange with a plurality of spokes; and a housing configured to couple to a silencer, the housing comprising an internal shoulder with a plurality of notches to receive a plurality of spokes of the piston flange;

wherein the piston is translatable relative to the housing in at least one of the proximal and distal directions during discharge of a firearm coupled to the piston, and wherein a peripheral surface of the piston flange contacts an inner surface of the housing and slides along the inner surface during translation of the piston relative to the housing, wherein the housing is positioned within a firearm silencer and further comprises a plurality of holes such that expanding gases produced from a discharged firearm coupled to the booster can escape the housing in a direction substantially transverse to the path of a discharge projectile.

2. The booster of claim 1, wherein the booster is configured such that when the notches of the internal shoulder receive the spokes of the piston flange, the internal shoulder prevents the housing from rotating relative to the piston.

3. The booster of claim 2, wherein the booster is further configured such that when the internal shoulder prevents rotation of the housing relative to the piston and when the booster is coupled to a silencer and a firearm, the silencer is prevented from rotating relative to the firearm.

4. The booster of claim 1, wherein the piston flange has ten spokes and the internal shoulder has ten notches.

5. The booster of claim 1, the booster further comprising a rear cap configured to couple to the housing, the rear cap comprising two features outwardly protruding from the distal face of the rear cap, the two features at opposite transverse locations on the rear cap to facilitate for removal of the rear cap.

6. The booster of claim 5, the booster further comprising an o-ring located interior to the rear cap, the o-ring positioned to contact the piston.

* * * * *